US011013331B2

(12) United States Patent
Beaucage et al.

(10) Patent No.: US 11,013,331 B2
(45) Date of Patent: May 25, 2021

(54) DRINK HOLDER ASSEMBLY

(71) Applicants: Sandra Beaucage, Key Largo, FL (US); Gary Beaucage, Key Largo, FL (US)

(72) Inventors: Sandra Beaucage, Key Largo, FL (US); Gary Beaucage, Key Largo, FL (US)

( * ) Notice: Subject to any disclaimer, the term of this patent is extended or adjusted under 35 U.S.C. 154(b) by 144 days.

(21) Appl. No.: 16/267,806

(22) Filed: Feb. 5, 2019

(65) Prior Publication Data

US 2020/0245771 A1 Aug. 6, 2020

(51) Int. Cl.
*A47C 7/62* (2006.01)
*A47C 1/14* (2006.01)
*A47C 11/00* (2006.01)

(52) U.S. Cl.
CPC ..... *A47C 7/624* (2018.08); *A47C 1/14* (2013.01); *A47C 11/005* (2013.01)

(58) Field of Classification Search
CPC ..... A47C 7/624; A47C 7/622; A47C 11/005; B60N 3/102; B60N 3/103
USPC ..... 297/248, 188.14
See application file for complete search history.

(56) References Cited

U.S. PATENT DOCUMENTS 506,085 A * 10/1893 Whelan ..... A47C 7/68 297/160
3,145,052 A * 8/1964 Morgan ..... B64D 11/0693 297/354.1
3,690,724 A * 9/1972 Douglas ..... A47C 7/62 297/188.18
3,807,319 A * 4/1974 Steanson, Jr. ..... A47C 7/62 108/42
3,893,569 A * 7/1975 Hoch ..... A47B 31/06 211/74
4,146,159 A * 3/1979 Hemmen ..... B60N 3/002 224/275
4,262,962 A * 4/1981 Yust ..... A47C 7/70 297/145
D263,784 S * 4/1982 Butler ..... D27/126
4,560,128 A 12/1985 Willeby
4,728,147 A * 3/1988 Dutton ..... A47C 7/62 248/230.8
4,844,399 A * 7/1989 Harm ..... A63B 55/60 248/311.2
D314,314 S * 2/1991 Shipman ..... D7/708
5,037,157 A * 8/1991 Wain ..... B60N 3/002 297/188.18
5,199,678 A 4/1993 Luebke
D341,521 S * 11/1993 Norbury ..... D7/552.2
5,295,650 A 3/1994 Brandt
(Continued)

*Primary Examiner* — David R Dunn
*Assistant Examiner* — Tania Abraham

(57) ABSTRACT

A drink holder assembly for attaching cup holders to outdoor chairs includes a block that is positionable between a respective arm rest on a pair of outdoor chairs. A strap is coupled to the block for wrapping around the respective arm rest on each of the outdoor chairs to removably couple the block between the outdoor chairs. A panel is positioned on the block and a pair of spacers is each positioned on top of the panel. A cup holder is positioned on each of the spacers such that the cup holder is spaced from the panel. The cup holder has a pair of cup holes therein and each of the cup holes insertably receives a cup having the cup resting upon the panel.

5 Claims, 5 Drawing Sheets

(56) References Cited

U.S. PATENT DOCUMENTS

| | | | | | |
|---|---|---|---|---|---|
| 5,395,085 | A * | 3/1995 | Mann | A47C 7/68 | 224/275 |
| 5,474,272 | A * | 12/1995 | Thompson | A47C 7/68 | 248/311.2 |
| 5,628,485 | A | 5/1997 | Ray | | |
| 5,667,180 | A * | 9/1997 | Duckworth | B60N 3/083 | 108/45 |
| 5,727,759 | A * | 3/1998 | Christensen | A47B 21/0371 | 248/118 |
| 5,797,655 | A * | 8/1998 | Miles | A47C 7/546 | 297/411.23 |
| 6,017,085 | A | 1/2000 | LaCroix | | |
| 6,739,652 | B2 | 5/2004 | Welsh | | |
| 7,216,930 | B2 * | 5/2007 | Steenson | A47C 7/70 | 297/145 |
| 7,261,369 | B2 * | 8/2007 | Ahad | B64D 11/06 | 297/115 |
| 8,333,429 | B2 * | 12/2012 | Nelson | A47C 7/62 | 297/188.18 |
| 8,632,123 | B2 * | 1/2014 | Barile | A47C 7/70 | 297/188.2 |
| 8,777,307 | B2 * | 7/2014 | Nelson | A47C 7/70 | 297/188.18 |
| 9,756,948 | B1 * | 9/2017 | Albite | A47C 7/546 | |
| 2018/0263394 | A1 * | 9/2018 | Thomas | A47C 7/664 | |

* cited by examiner

DRINK HOLDER ASSEMBLY

STATEMENT REGARDING FEDERALLY SPONSORED RESEARCH OR DEVELOPMENT

Not Applicable

CROSS-REFERENCE TO RELATED APPLICATIONS

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to holder devices and more particularly pertains to a new holder device for attaching cup holders to outdoor chairs.

BRIEF SUMMARY OF THE INVENTION

An embodiment of the disclosure meets the needs presented above by generally comprising a block that is positionable between a respective arm rest on a pair of outdoor chairs. A strap is coupled to the block for wrapping around the respective arm rest on each of the outdoor chairs to removably couple the block between the outdoor chairs. A panel is positioned on the block and a pair of spacers is each positioned on top of the panel. A cup holder is positioned on each of the spacers such that the cup holder is spaced from the panel. The cup holder has a pair of cup holes therein and each of the cup holes insertably receives a cup having the cup resting upon the panel. In this way the cup holder facilitates a pair of cups to be held on the outdoor chairs.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
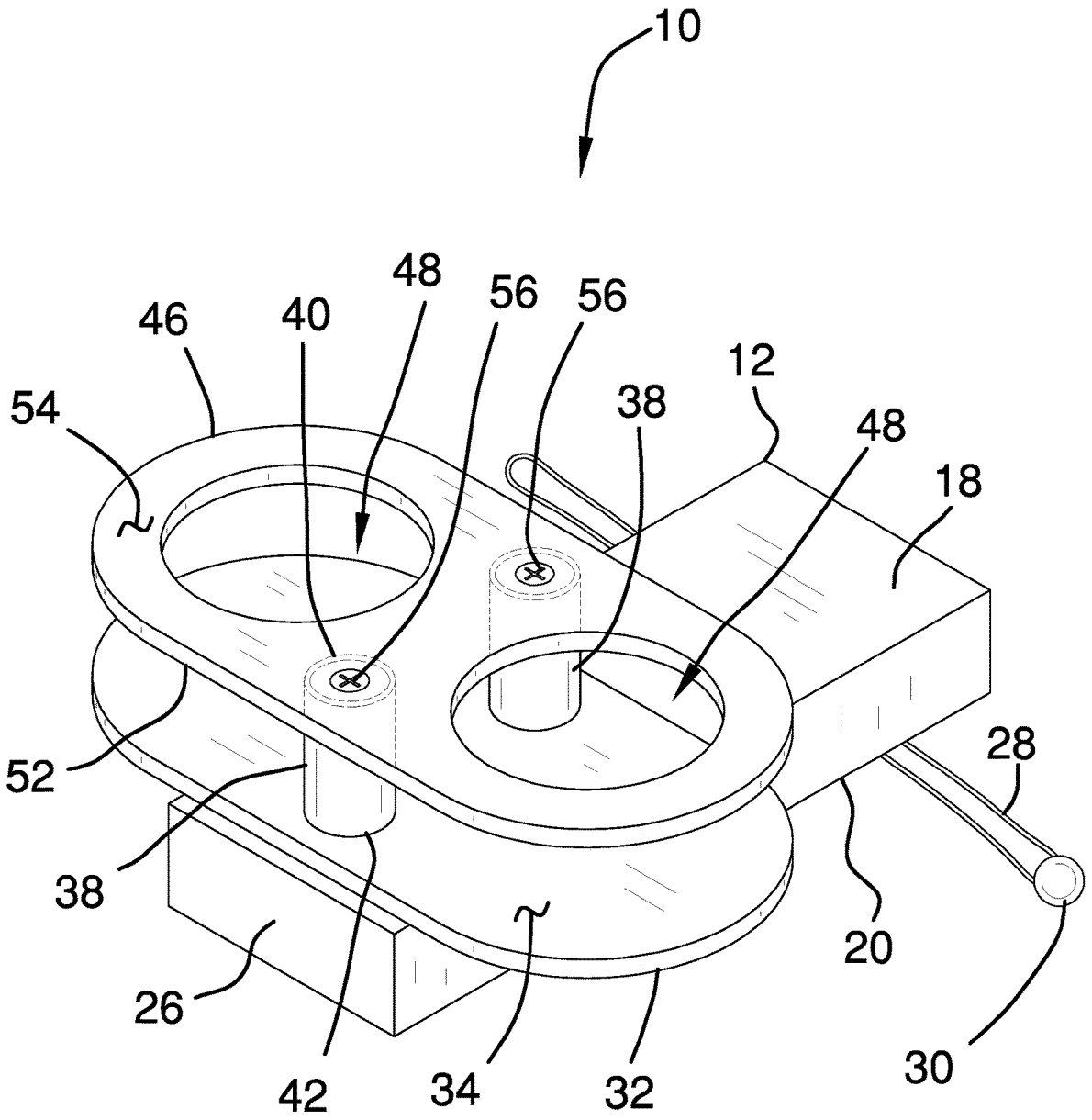
FIG. 1 is a top perspective view of a drink holder assembly according to an embodiment of the disclosure.
Figure 2:
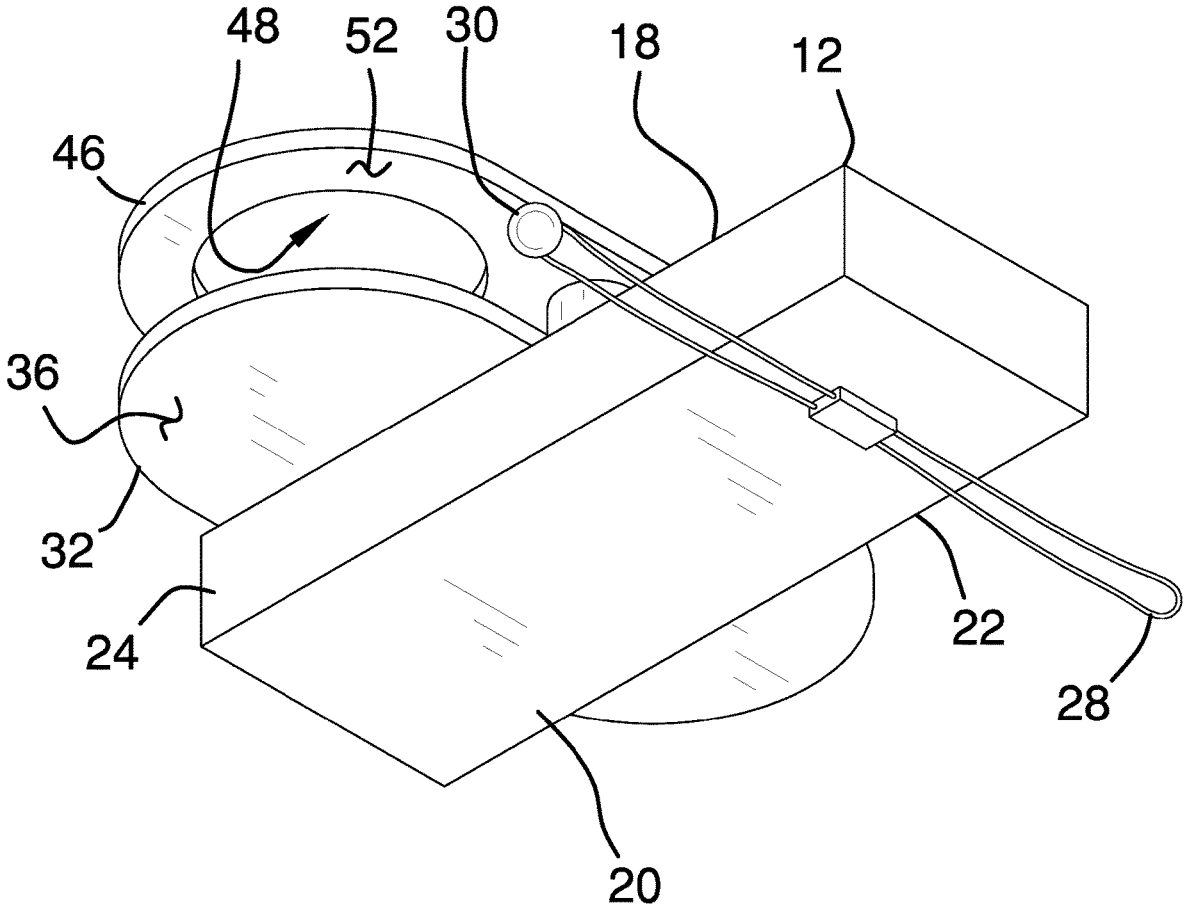
FIG. 2 is a bottom perspective view of an embodiment of the disclosure.
Figure 3:
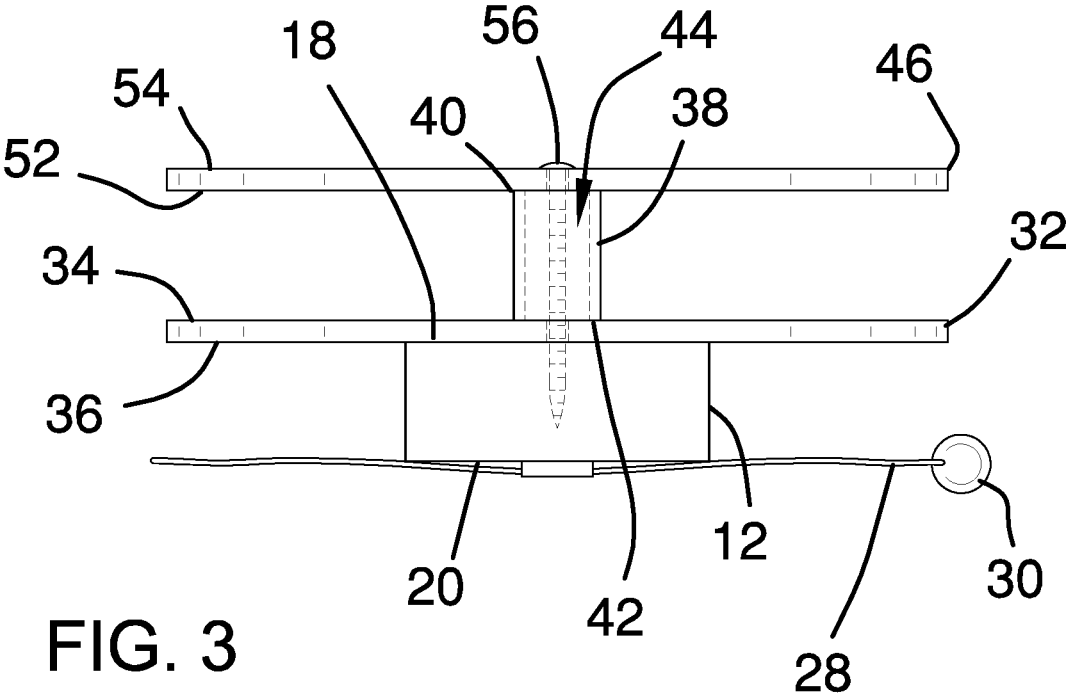
FIG. 3 is a back view of an embodiment of the disclosure.
Figure 4:
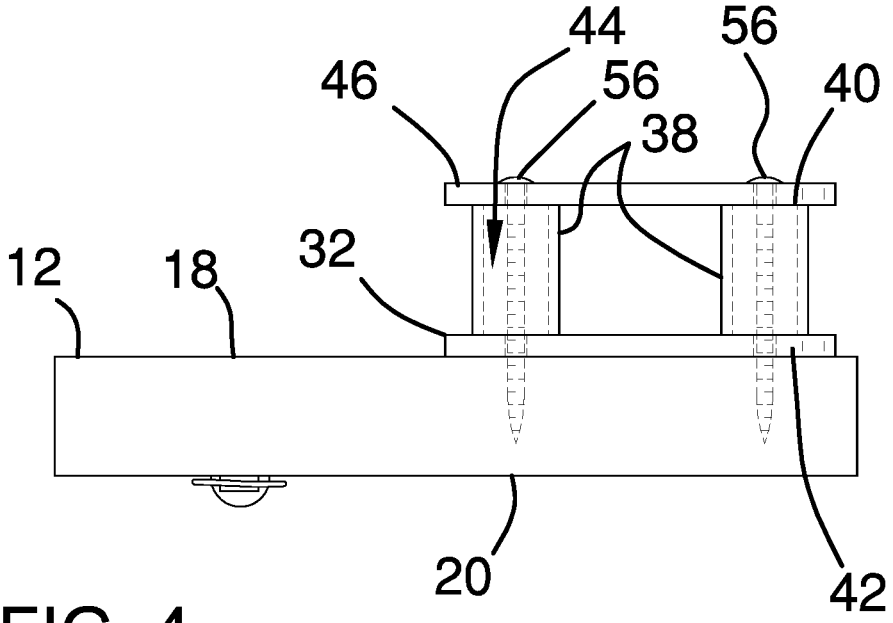
FIG. 4 is a right side phantom view of an embodiment of the disclosure.
Figure 5:
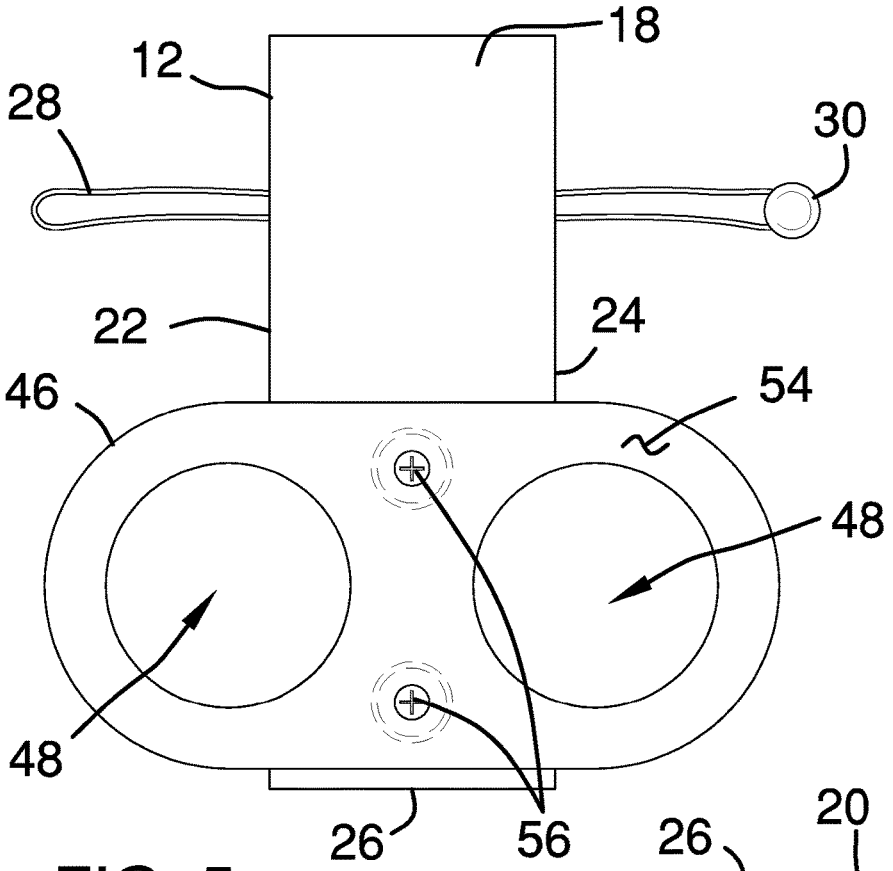
FIG. 5 is a top view of an embodiment of the disclosure.
Figure 6:
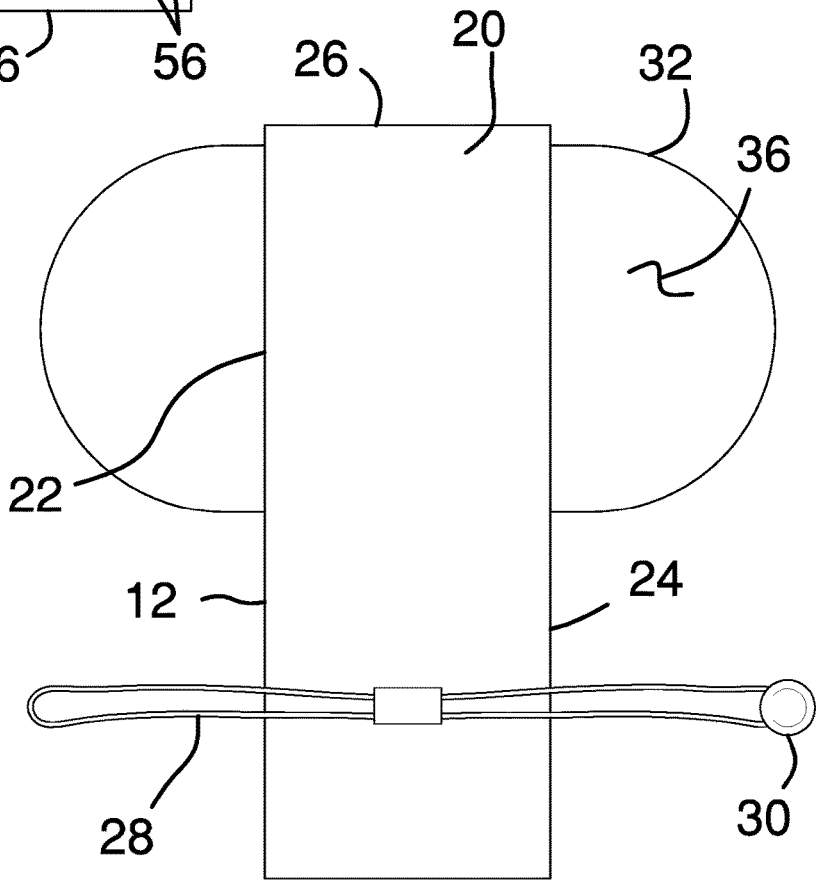
FIG. 6 is a bottom view of an embodiment of the disclosure.
Figure 7:
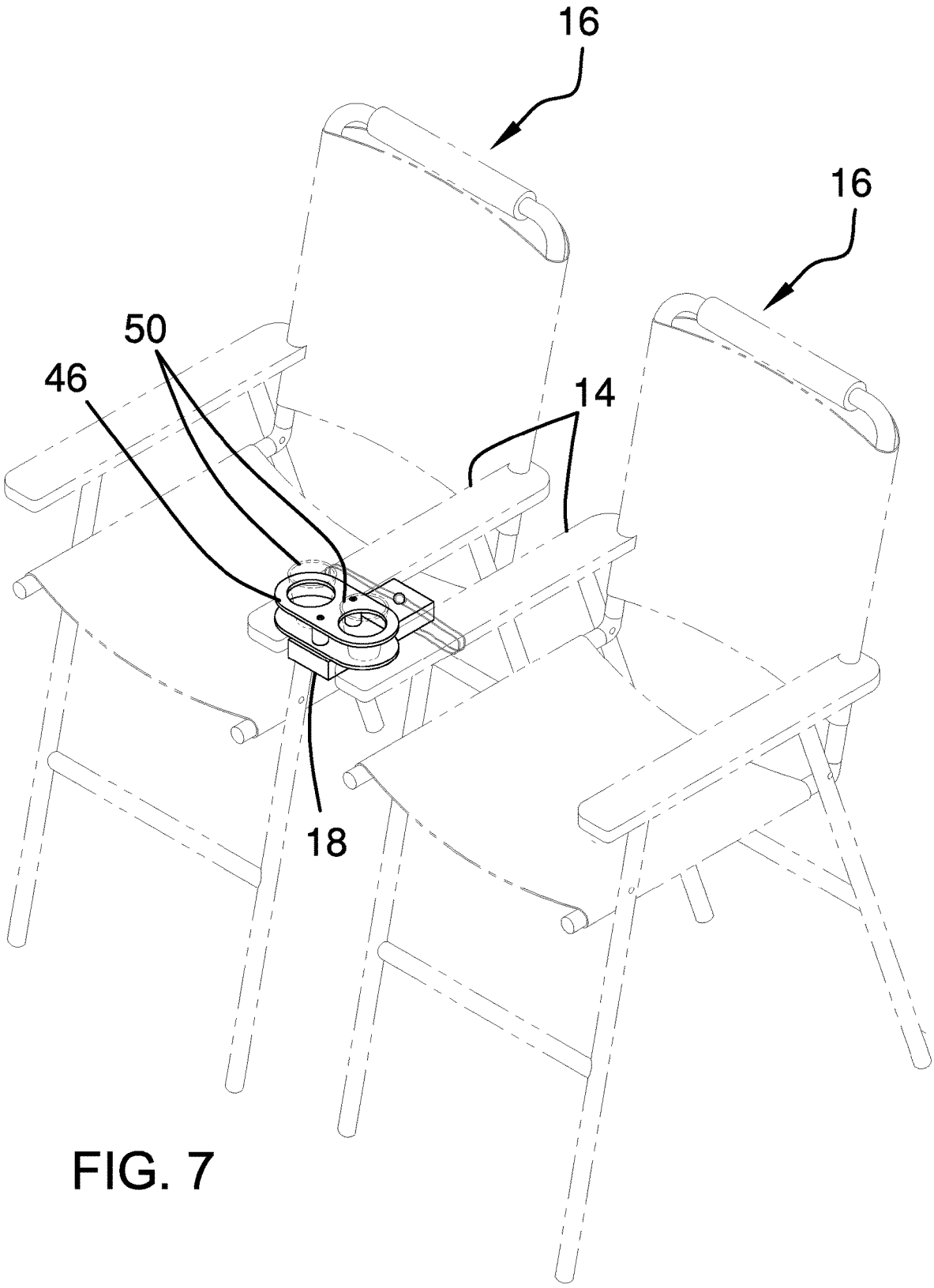
FIG. 7 is a perspective in-use view of an embodiment of the disclosure.

With reference now to the drawings, and in particular to FIGS. 1 through 7 thereof, a new drink holder assembly embodying the principles and concepts of an embodiment of the disclosure and generally designated by the reference numeral 10 will be described.

As best illustrated in FIGS. 1 through 7, the drink holder assembly 10 generally comprises a block 12 that is positionable between a respective arm rest 14 on a pair of outdoor chairs 16 that do not have cup holder 46*s*. The block 12 has a top side 18, a bottom side 20, a first lateral side 22, a second lateral side 24 and a first end 26. The first lateral side 22 abuts the respective arm rest 14 on a respective one of the outdoor chairs 16. The second lateral side 24 abut the respective arm rest 14 on a respective one of the outdoor chairs 16. The top side 18 lies on a plane that is horizontally oriented when the block 12 is positioned between the outdoor chairs 16. The outdoor chairs 16 may be lawn chairs, a folding chairs or any other sort of chairs commonly employed outdoors.

A strap 28 is coupled to the block 12 and the strap 28 is comprised of a resiliently stretchable material. The strap 28 is wrapped around the respective arm rest 14 on each of the outdoor chairs 16 for removably coupling the block 12 between the outdoor chairs 16. The strap 28 is positioned on the bottom side 20 of the block 12 and the strap 28 extends outwardly beyond each of the first 22 and second 24 lateral sides of the block 12. Moreover, the strap 28 is wrapped to form a closed loop and the strap 28 has a ball 30 coupled thereto. The ball 30 has the strap 28 wrapped therearound when the strap 28 is wrapped around the respective arm rest 14 on each of the outdoor chairs 16. In this way the strap 28 is retained around the respective arm rest 14 on each of the outdoor chairs 16.

A panel 32 is positioned on the block 12 and the panel 32 is elongated along a line that is oriented perpendicular to a longitudinal axis of the block 12. The panel 32 has a top surface 34 and a bottom surface 36, and the bottom surface 36 is rests on the top surface 34 of the block 12. The panel 32 is aligned with the first end 26 of the block 12 and the block 12 is centrally positioned on the bottom surface 36 of the panel 32. A pair of spacers 38 is each positioned on top of the panel 32. Each of the spacers 38 has a top end 40, a bottom end 42 and an aperture 44 extending through the top 40 and bottom 42 ends. The bottom end 42 of each of the spacers 38 is positioned on the top surface 34 of the panel 32, the spacers 38 are spaced apart from each other on the panel 32 and each of the spacers 38 is aligned with and is distributed along the longitudinal axis of the block 12.

A cup holder 46 is positioned on each of the spacers 38 such that the cup holder 46 is spaced upwardly from the panel 32. The cup holder 46 has a pair of cup holes 48 therein and each of the cup holes 48 insertably receives a cup 50, or other beverage container, having the cup resting upon the panel 32. In this way the cup holder 46 facilitates a pair of cups 50 to be held on the outdoor chairs 16 that do not have cup holders built into them. The cup holder 46 has a lower surface 52 and an upper surface 54, and each of the cup holes 48 extends through the upper 54 and lower 52 surfaces. The cup holes 48 are spaced apart from each other and the cup holder 46 is oriented to be coextensive with the panel 32. A pair of fasteners 56, such as screws or the like, each extends through the cup holder 46, through the aperture 44 in a respective one of the spacers 38, through the panel 32 and into the block 12 for attaching each of the panel 32 and the cup holder 46 to the block 12.

In use, the block 12 is positioned between the respective arm rest 14 on each of the outdoor chairs 16 and the strap 28 is wrapped around the respective arm rest 14 on each of the outdoor chairs 16 to attach the block 12 between the outdoor chairs 16. Thus, the cup holder 46 is positioned in a horizontal orientation for insertably receiving the cups 50. In this way the cups 50 can be held when the outdoor chairs 16 do not have cup holders of their own. Additionally, a plate of food or the like can be rested on top of the cup holder 46 for holding the plate of food.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A drink holder assembly being configured to be removably coupled between a pair of outdoor chairs for holding beverages, said assembly comprising:

a block being positionable between a respective arm rest on a pair of outdoor chairs, said block has a top side, a bottom side, a first lateral side, a second lateral side and a first end, said first lateral side abutting the respective arm rest on a respective one of the outdoor chairs, said second lateral side abutting the respective arm rest on a respective one of the outdoor chairs, said top side lying on a plane being horizontally oriented when said block is positioned between the outdoor chairs;

a strap being coupled to said block, said strap being comprised of a resiliently stretchable material, said strap being wrapped around the respective arm rest on each of the outdoor chairs for removably coupling said block between the outdoor chairs, said strap being positioned on said bottom side of said block, said strap extending outwardly beyond each of said first and second lateral sides of said block, said strap being wrapped to form a closed loop, said strap having a ball being coupled thereto, said ball having said strap wrapped therearound when said strap is wrapped around the respective arm rest on each of the outdoor chairs for retaining said strap around the respective arm rest on each of the outdoor chairs;

a panel being positioned on said block, said panel being elongated along a line being oriented perpendicular to a longitudinal axis of said block;

a pair of spacers, each of said spacers being positioned on top of said panel; and a cup holder being positioned on each of said spacers such that said cup holder is spaced from said panel, said cup holder having a pair of cup holes therein, each of said cup holes insertably receiving a cup having the cup resting upon said panel wherein said cup holder is configured to facilitate a pair of cups to be held on the outdoor chairs.

2. The assembly according to claim 1, wherein said panel has a top surface and a bottom surface, said bottom surface being attached to said top side of said block, said panel being aligned with said first end of said block, said block being centrally positioned on said bottom surface of said panel.

3. A drink holder assembly being configured to be removably coupled between a pair of outdoor chairs for holding beverages, said assembly comprising:

a block being positionable between a respective arm rest on a pair of outdoor chairs, said block has a top side, a bottom side, a first lateral side, a second lateral side and a first end, said first lateral side abutting the respective arm rest on a respective one of the outdoor chairs, said second lateral side abutting the respective arm rest on a respective one of the outdoor chairs, said top side lying on a plane being horizontally oriented when said block is positioned between the outdoor chairs;

a strap being coupled to said block, said strap being comprised of a resiliently stretchable material, said strap being wrapped around the respective arm rest on each of the outdoor chairs for removably coupling said block between the outdoor chairs;

a panel being positioned on said block, said panel being elongated along a line being oriented perpendicular to a longitudinal axis of said block, said panel having a top surface and a bottom surface, said bottom surface being attached to said top surface of said block, said panel being aligned with said first end of said block, said block being centrally positioned on said bottom surface of said panel;

a pair of spacers, each of said spacers being positioned on top of said panel;

a cup holder being positioned on each of said spacers such that said cup holder is spaced from said panel, said cup holder having a pair of cup holes therein, each of said cup holes insertably receiving a cup having the cup resting upon said panel wherein said cup holder is configured to facilitate a pair of cups to be held on the outdoor chairs; and each of said spacers has a top end, a bottom end and an aperture extending through said top and bottom ends, said bottom end of each of said spacers being positioned on said top surface of said panel, said spacers being spaced apart from each other on said panel, each of said spacers being aligned with and being distributed along said longitudinal axis of said block.

4. The assembly according to claim 3, further comprising:

said cup holder having a lower surface and an upper surface, each of said cup holes extending through said upper and lower surfaces, said cup holes being spaced apart from each other, said cup holder being oriented to be coextensive with said panel; and a pair of fasteners, each of said fasteners extending through said cup holder, through said aperture in a respective one of said spacers, through said panel and into said block for attaching each of said panel and said cup holder to said block.

5. A drink holder assembly being configured to be removably coupled between a pair of outdoor chairs for holding beverages, said assembly comprising:

a block being positionable between a respective arm rest on a pair of outdoor chairs, said block having a top side, a bottom side, a first lateral side, a second lateral side and a first end, said first lateral side abutting the respective arm rest on a respective one of the outdoor chairs, said second lateral side abutting the respective arm rest on a respective one of the outdoor chairs, said top side lying on a plane being horizontally oriented when said block is positioned between the outdoor chairs;

a strap being coupled to said block, said strap being comprised of a resiliently stretchable material, said strap being wrapped around the respective arm rest on each of the outdoor chairs for removably coupling said block between the outdoor chairs, said strap being positioned on said bottom side of said block, said strap extending outwardly beyond each of said first and second lateral sides of said block, said strap being wrapped to form a closed loop, said strap having a ball being coupled thereto, said ball having said strap wrapped therearound when said strap is wrapped around the respective arm rest on each of the outdoor chairs for retaining said strap around the respective arm rest on each of the outdoor chairs;

a panel being positioned on said block, said panel being elongated along a line being oriented perpendicular to a longitudinal axis of said block, said panel having a top surface and a bottom surface, said bottom surface being attached to said top surface of said block, said panel being aligned with said first end of said block, said block being centrally positioned on said bottom surface of said panel;

a pair of spacers, each of said spacers being positioned on top of said panel, each of said spacers having a top end, a bottom end and an aperture extending through said top and bottom ends, said bottom end of each of said spacers being positioned on said top surface of said panel, said spacers being spaced apart from each other on said panel, each of said spacers being aligned with and being distributed along said longitudinal axis of said block;

a cup holder being positioned on each of said spacers such that said cup holder is spaced from said panel, said cup holder having a pair of cup holes therein, each of said cup holes insertably receiving a cup having the cup resting upon said panel wherein said cup holder is configured to facilitate a pair of cups to be held on the outdoor chairs, said cup holder having a lower surface and an upper surface, each of said cup holes extending through said upper and lower surfaces, said cup holes being spaced apart from each other, said cup holder being oriented to be coextensive with said panel; and a pair of fasteners, each of said fasteners extending through said cup holder, through said aperture in a respective one of said spacers, through said panel and into said block for attaching each of said panel and said cup holder to said block.

* * * * *